United States Patent [19]

Saurenman

[11] 3,976,916

[45] Aug. 24, 1976

[54] ANTISTATIC EQUIPMENT

[75] Inventor: Donald G. Saurenman, Whittier, Calif.

[73] Assignee: Consan Pacific Incorporated, Whittier, Calif.

[22] Filed: Jan. 15, 1975

[21] Appl. No.: 541,262

[52] U.S. Cl. ..... 317/4; 317/2 F; 317/262 AE

[51] Int. Cl.[2] ..... H01T 19/04

[58] Field of Search ..... 317/2 R, 2 F, 3, 4, 317/262 AE; 250/324–326; 128/190; 313/309, 351

[56] References Cited

UNITED STATES PATENTS

| | | | |
|---|---|---|---|
| 2,765,975 | 10/1956 | Lindenblad | 317/3 UX |
| 3,308,344 | 3/1967 | Smith et al. | 317/4 |
| 3,358,289 | 12/1967 | Lee | 250/325 |
| 3,757,491 | 9/1973 | Gourdine | 317/4 |
| 3,818,269 | 6/1974 | Stark | 317/4 |
| 3,870,946 | 3/1975 | Sandorf | 317/3 |

FOREIGN PATENTS OR APPLICATIONS

| | | | |
|---|---|---|---|
| 1,028,351 | 5/1966 | United Kingdom | 313/309 |

*Primary Examiner*—Harry Moose
*Attorney, Agent, or Firm*—William W. Haefliger

[57] ABSTRACT

Apparatus for generating and dispersing ions comprises a. an electrically insulative carrier, b. integral means forming multiple relatively closely spaced metallic tips extending in generally the same direction, said means carried by said carrier and c. means electrically connected with said integral means for supplying high voltage to said tips.

7 Claims, 7 Drawing Figures

FIG. 3.
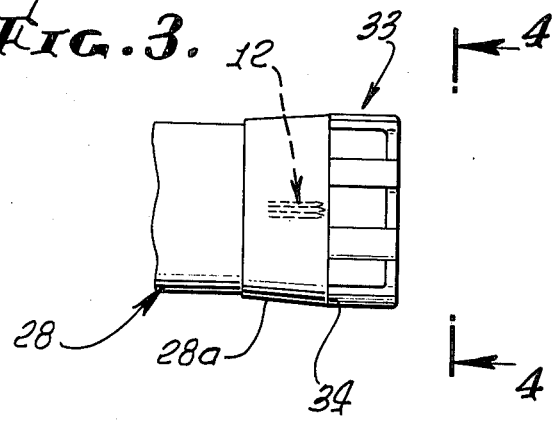
FIG. 5.
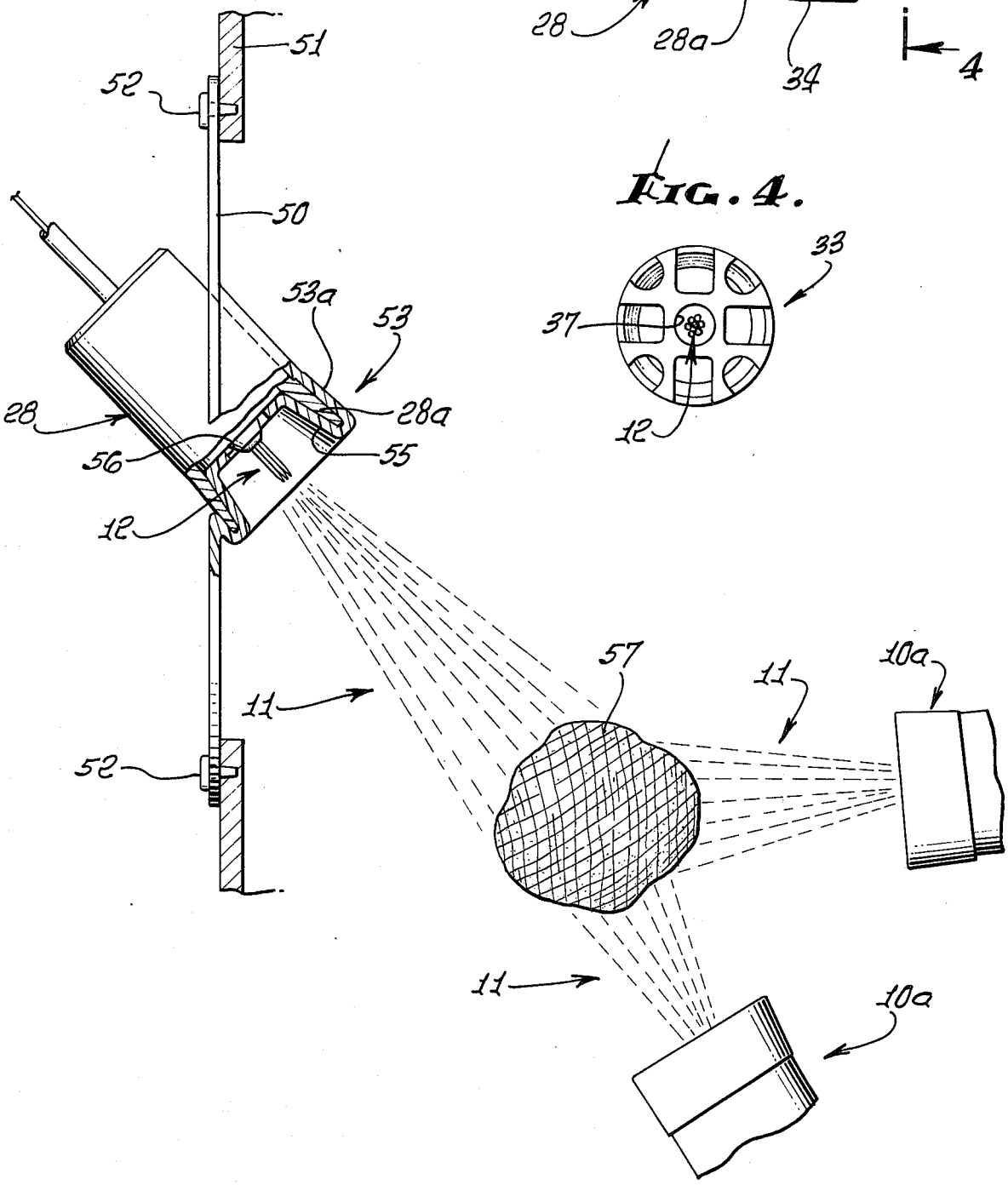
FIG. 4.

ANTISTATIC EQUIPMENT

BACKGROUND OF THE INVENTION

This invention relates generally to antistatic treatment of electrically charged objects, and more particularly concerns improvements in ion generation and dispensing apparatus for altering the static charge on work surfaces.

In certain processing operations there has long been a need for removing static charge from work surfaces. Typical processing apparatus where static charge builds up on fiber or paper surfaces includes the following: feeder aprons in cotton gin stands, cotton gin lint cleaners, slides and overhead feed distributors, rollers in cotton roller gins, textile mill card webs, sliver and tow, and looms for processing either natural or synthetic fibers, paper handling equipment such as printing presses and rug fiber manufacturing, process, handling and transporting equipment and hair treating apparatus. In addition, moving particles and material, and even people walking over rugs and other surfaces often generate static charge, the intensity of which can be increased by weather conditions, including temperature and humidity. Such charge build-up often results in balling, sticking and jamming of the fiber, paper or hair being processed, inhibiting the efficiency of the processing operation. Past efforts to solve this problem have not proved to be entirely satisfactory, and do not offer the unusual features and advantages of the present invention, insofar as we are aware. In this regard, the invention represents significant improvements over apparatus as disclosed in U.S. Pat. No. 3,308,344 to Smith et al.

SUMMARY OF THE INVENTION

It is a major object of the present invention to overcome the charge build-up problems discussed above through the provision of unusually effective, simple and compact ion generating and dispensing apparatus for altering, as for example neutralizing or changing, the static charge on work surfaces. It is a major object of the invention to provide, in apparatus, a. an electrically insulative carrier, b. integral means forming multiple relatively closely spaced metallic tips extending in generally the same direction, said means carried by said carrier and c. means electrically connected with said integral means for supplying high voltage to said tips.

As will be seen, the integral means may advantageously comprise a cluster of needle shanks, which extend in parallel relation so as to be capable of integration into a unit by a rigid bond such as solder. The latter has capillary positioning in spaces formed by and between the shanks, and a metallic base typically supports the shanks at their ends opposite the tips. A conductive coating is also applicable over the entire unit.

It is another object of the invention to provide a method of forming such tips, and which includes the steps:

a. providing a base having a recess therein, b. providing a cluster of metallic needles extending in side by side relation, the needles forming said tips and oriented to project upwardly, c. locating the ends of the needles remote from said tips in said recess, and in contact with molten solder or the like in said recess, and d. allowing the molten solder to rise by capillary action in the spaces between the needles and then harden therein.

Other unusual objects and advantages of the invention include the provision of plastic carrier insert and hollow body elements facilitating quick assembly of the apparatus; the provision of means to prevent pull-out of a power supply wire and sheath from the carrier, the wire electrically connected with the needle base as described; the provision of a plastic safety grid over the needle tips clustered as described; the provision of a unitized plastic sheet and receptacle, the latter sized to removably receive the carrier body so as to expose the needle tips to work at one side of that sheet, which is connectible to duct or other structure remotely from the tips; the provision of power supply unit wherein foamed plastic is contained against circuit elements to prevent their exposure to dirt etc., and prevent vibration induced dislodgement thereof; and the provision of a method of ion treatment of work elements to prevent adherence of the elements, one to another.

These and other objects and advantages of the invention, as well as the details of illustrative embodiments will be more fully understood from the following detailed description of the drawings in which:

DRAWING DESCRIPTION

FIG. 3 is fragmentary side elevation showing a modification;

FIG. 4 is an end elevation on lines 4—4 of FIG. 3;

FIG. 5 is a side elevation, partly in section, showing a further modification;

DETAILED DESCRIPTION

Figure 1:
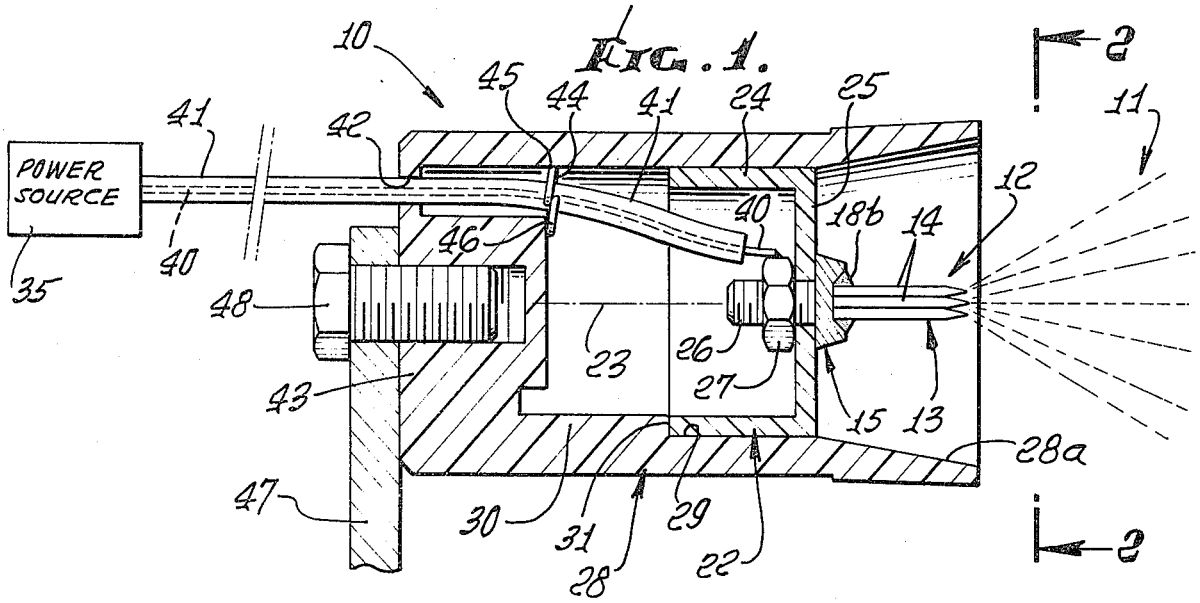
FIG. 1 is a vertical section, in side elevation.
Figure 2:
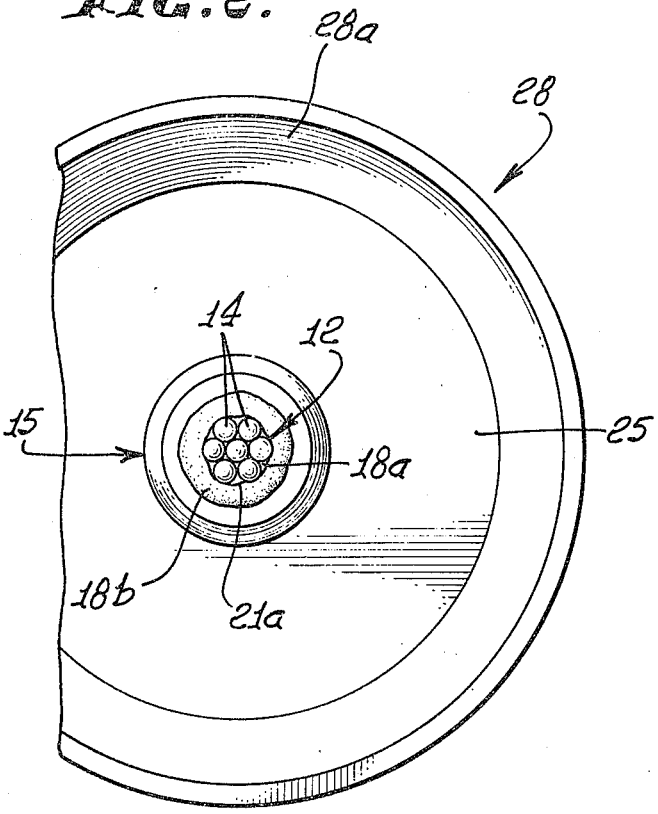
FIG. 2 is an enlarged end elevation taken on lines 2—2 of FIG. 1.

In FIGS. 1 and 2, apparatus 10 generates and disperses ions indicated by broken lines 11 as traveling rightwardly from multiple relatively closely spaced metallic pointed tips 12. The latter extend in generally the same rightward direction, and are formed by integral means which may typically and advantageously comprise a cluster 13 of metallic (for example steel) needle shanks 14 extending in adjacent and parallel relation. Such integral means may also and with unusual advantage comprise a rigid bond such as solder holding the shanks in that relationship.

Figure 7:
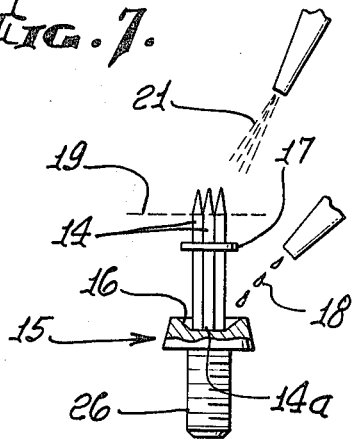
FIG. 7 is an enlarged vertical elevation showing a method of forming a multiple tip cluster.

The formation of the bonded needle cluster may be rapidly carried out by providing a metallic base 15 as for example of brass, and orienting it vertically so that a cup-shaped recess 16 therein is upwardly exposed as seen in FIG. 7. The needle shanks 14 are then clustered and retained by a removable band 17, and their ends **14*a* remote from the tips centered in the recess 16. Next, molten solder 18 as for example silver solder, is poured into recess 16 to fill same, the solder rising by capillary attraction into the small spaces between the clustered needle shanks, and to a level indicated by broken line 19 near the bases of the tapered tips 12. The hardened solder holds the shanks together and firmly retains the needle cluster to the base 15. Finally, the entire assembly may be subjected to application of an electrically conductive coating, such as gold applied by a spray 21**, or dipping, or other means.

FIG. 2 shows the hardened solder 18*a* in the spaces formed between the needle shanks, the solder 18*b* filling recess 16, and the conductive coating 21*a* on the exposed surfaces of the needles and hardened solder. The clustering of the tips, as described, provides a substantial improvement in ion generation and dispersing, for the same power and voltage application, as compared with the widely spaced needle arrangement as described in U.S. Pat. No. 3,308,344. For example, tests show that about a 20% or better improvement. Another advantage consists in the much improved ease of handling factor; thus, a worker may moderately press his finger against the tip cluster 12 without tip penetration of the skin; whereas, one may not even lightly press his finger against a single needle in U.S. Pat. No. 3,308,344 without needle penetration of the skin.

Referring back to FIG. 1, the electrically insulative carrier is shown to advantageously comprise a molded plastic insert 22 defining an axis 23, and carrying the base 15 at the axis so that the needle also project axially and centrally. The cup-shaped insert may have an annular skirt 24 and a wall 25 to which the base 15 is connected as by a threaded axial shank 26 integral with the base and a nut 27. Shank 26 projects centrally and rearwardly through the wall 25, as shown. The carrier may also include a molded plastic hollow body 28 receiving the insert, the inner annular wall 29 of the body engaging the skirt 24. Ribs 30 integral with the body may limit rearward insertion of the insert into the body as at interengagement locus 31. The annular mouth 28*a* of the body 28 flares forwardly about the needle tip cluster 12 to aid in directing the ion flow indicated at 11. FIGS. 3 and 4 show a molded plastic grid-work shield 33 attached as by bonding at 34 to the rim of the mouthpiece 28*a*, the shield or grid extending openly across the zone of forward flow of the ion stream, to protect the user from high voltage applied to the tips 12 as via power source 35. The latter may be as described in U.S. Pat. No. 3,308,344. Between 10,000 and 20,000 volts DC are typically applied to the needles. Note the central opening 37 in the grid 33, in alignment with the needle cluster, to pass the axial stream of ions, without obstruction.

Power is supplied from unit 35 to the base 15 and the needle cluster via a wire 40 surrounded by a plastic sheath 41. The latter passes through an opening 42 in the end wall 43 of body 28. Means, such as C-ring 44 clamped on the sheath, jams against the wall surfaces 45 and 46 of the body 28 to prevent pull-out of the wire and sheath from that body. The end of the wire may be soldered to conductive nut 27. Support structure 47 for the apparatus 10 may be attached to the end wall 43 via a suitable fastener 48.

FIG. 5 shows the provision of a flexible plastic disc or sheet 50 attachable to duct or other support structure 51 as via fasteners 52. The electrically insulative sheet, which may or may not be transparent, includes a molded receptacle 53 removable receiving the carrier body 28 to mount same in widely spaced relation to the metallic structure 51, thereby preventing arcing problems. The sheet may consist of molded silicone rubber having structural integrity at elevated temperature, as for example up to around 1,500°F, for protection against constant heat exposure at temperature between 800°F and 1,000°F. The receptacle 53 may include a re-entrant portion 55 containing a central opening 56 in alignment with the needle tip cluster, to openly pass same as shown. Re-entrant annular wall 55 is spaced inwardly from the flared annular extent 53*a* of the receptacle, to loosely but frictionally receive the flared mouthpiece 28*a* of the body 28 therebetween, for removably retaining that mouthpiece in operative position as shown. An object subjected to ion treatment is seen at 57 and may comprise a textile mass, fibers, plastic material, or other work. Additional or multiple apparatus is shown at 10*a* as positioned to treat all sides of the work to the same polarity ions, so that individual components of the work will not statically adhere to one another.

Figure 6:
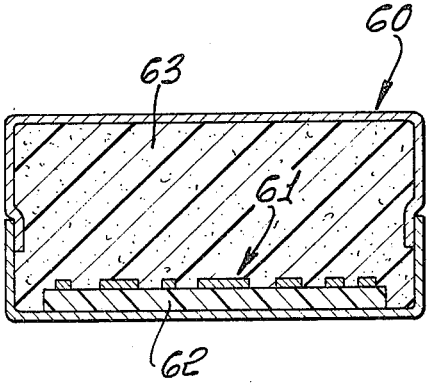
FIG. 6 is a vertical section through a power unit.

FIG. 6 shows, in cross section, a metallic container 60 for power supply circuitry 61 mounted on a circuit board 62 within the container. Foamed plastic such as polyurethane 63 fills the container and covers the circuitry 61, retaining the latter in position against jarring loose under vibration conditions. Circuitry 61 is that used in power source 35.

I claim:

1. In apparatus for generating and dispersing ions, a. an electrical insulative carrier, b. a cluster of parallel needles having adjacent shanks and forming multiple relatively closely spaced metallic tips extending in the same direction, said needles carried by said carrier, and c. means electrically connected with said needles for supplying high voltage to said tips, said means including solder extending in the interstices formed by and between said shanks, and a metallic base supporting said solder and said shanks at the ends thereof opposite said tips.

2. In apparatus for generating and dispersing ions, a. an electrically insulative carrier, b. integral means forming multiple relatively closely spaced metallic tips extending in generally the same direction, said means carried by said carrier and comprising a cluster of needle shanks which extend in adjacent parallel relation, and a rigid bond holding said shanks in said adjacent parallel relation, said bond comprising solder having capillary positioning in spaces formed between said shanks, and there being a metallic base supporting said solder and said shanks at the ends thereof opposite said tips, and c. means electrically connected with said integral means for supplying high voltage to said tips, d. said insulative carrier including a molded plastic insert defining an axis and carrying said base at said axis, and a molded plastic hollow body receiving said insert.

3. The apparatus of claim 2 including a wire received within said body and electrically connected with said metallic base, there being plastic sheathing on said wire, and there being means on said sheathing blocking pull-out displacement of the sheathing and wire from said body.

4. The apparatus of claim 1 wherein said carrier includes a cylindrical portion extending about and receiving said tips, said portion forming an outlet to pass ions dispersed by said tips, there being a molded plastic grid on said portion and extending in alignment with said outlet.

5. In apparatus for generating and dispersing ions, a. an electrically insulative carrier, b. integral means forming multiple relatively closely spaced metallic tips extending in generally the same direction, said means carried by said carrier and c. means electrically connected with said integral means for supplying high voltage to said tips, d. said carrier including a cylindrical portion extending about and receiving said tips, said portion forming an outlet to pass ions dispersed by said tips, there being a molded plastic sheet forming a receptacle receiving said cylindrical portion of the carrier to mount the carrier.

6. The apparatus of claim 5 including structure supporting said sheet near the periphery thereof.

7. The apparatus of claim 1 wherein said means to supply high voltage to the tips comprises power circuitry, a container for said circuitry, and foamed plastic substantially filling the container and covering said circuitry.

* * * * *